United States Patent [19]

Evenson

[11] Patent Number: 4,946,352

[45] Date of Patent: Aug. 7, 1990

[54] DUAL ACTION PISTON PUMP

[75] Inventor: Randy Evenson, Houston, Tex.

[73] Assignee: Multi-Pump, Inc., Germantown, Ohio

[21] Appl. No.: 413,850

[22] Filed: Sep. 28, 1989

[51] Int. Cl.[5] ..... F04B 17/00

[52] U.S. Cl. ..... 417/396; 417/63

[58] Field of Search ..... 417/397, 63, 396

[56] References Cited

U.S. PATENT DOCUMENTS

| | | | |
|---|---|---|---|
| 16,366 | 1/1857 | Gedney | 417/517 |
| 329,417 | 10/1885 | Tubbs | 417/396 |
| 3,016,016 | 1/1962 | Horlacher | 417/396 |
| 3,450,055 | 6/1969 | England | 417/396 |
| 4,236,880 | 12/1980 | Archibald | 417/63 X |
| 4,419,055 | 12/1983 | Burk | 417/396 |
| 4,474,540 | 10/1984 | Bonastia et al. | 417/63 |

*Primary Examiner*—John Rivell

*Attorney, Agent, or Firm*—Charles J. Prescott; Raymond H. Quist

[57] ABSTRACT

A dual action piston pump has a centrally disposed pump cylinder having a pump piston therein. A transition section is secured to each end of said pump cylinder through which the media being pumped passes while being pumped from and to a four way valve. A piston rod is connected to each side of said pump piston. Each piston rod passes through the side wall of the transition section and extends into a drive cylinder where it is connected to a drive piston. The drive pistons are driven by a motive fluid which may be hydraulic fluid. Each drive cylinder has a motive fluid connection adjacent to its distal and proximal ends so that both drive pistons can be driven in both directions. As the pump piston moves in one direction media is being pumped out on one side while media is being drawn in on the opposite side. The four way valve connects one side of the cylinder to a suction intake and the other side of the cylinder to the discharge. The valve reverses these connections when the stroke of the pistons reverse.

13 Claims, 2 Drawing Sheets

DUAL ACTION PISTON PUMP

BACKGROUND OF THE INVENTION

1. Field of the Invention

This invention relates generally to a positive displacement pump, and more particularly to a dual action piston pump.

2. Description of Related Art

Positive displacement pumps which operate so as to have discharge in one portion while simultaneously having intake in another portion have long been known.

Gedney, U.S. Pat. No. 16,366, entitled "Double-Acting Pump", discloses one such pump having two separate piston and cylinder units operating in this manner.

McIntire, U.S. Pat. No. 208,192, entitled "Force-Pump", discloses a pump operating in this manner having a single piston and cylinder. The piston rod extends from one end of the cylinder.

Boyle, U.S. Pat. No. 4,580,954, entitled "Oscillating-Deflector Pump", discloses a pair of pumps, each having two cylinders and pistons.

The valves or deflectors used in the foregoing devices are generally of the same four way valve configuration.

French Pat. No. 2.226.019, discloses a double acting pump having adjustable frequency and length of stroke. This patent has a sleeve piston which controls operation of the two pump pistons by alternately moving one to close the intake from a hopper and opening the discharge while the other in the opposite mode.

The present dual action pump employs a single, centrally located piston and cylinder with coaxial drive pistons on the opposite ends. Inspection ports permit observation of interior operation and are readily removed for maintenance. The valve spade shifts across pump ports and not across suction and discharge ports providing safer operation.

SUMMARY OF THE INVENTION

A centrally disposed pump cylinder has a piston disposed therein. Piston rod sections extend from both sides of the pump piston to drive pistons and drive cylinders at each end. Both sides of the pump cylinder therefore have equal displacement volumes. Pump transition sections having inspection ports are mounted between the pump cylinder and the drive cylinders. Downwardly extending from the pump transition sections are truncated conical conduits of decreasing diameter. The bottom ends of the conical conduits are connected to one end of tubes having the other ends connected to a four way valve. In addition to the tube connections, the valve has a suction intake connection and a discharge connection. The valve spade has a first position where the suction intake is connected to the pump cylinder on a first side of the pump piston, and the discharge is connected to the pump cylinder on the second side of the pump piston. The valve spade has a second position where the connections are reversed. An actuator moves the valve spade between these two positions across the pump conections. The suction intake has an area at least twice that of the discharge.

It is therefore an object of this invention to provide a dual action piston pump in which fluid passing to and from the pump cylinder is decelerated and accelerated to prevent the same fluid from stagnating.

It is also an object of this invention to provide a dual action piston pump having equal displacements on both sides of the pump cylinder.

It is a further object of this invention to provide a dual action piston pump having inspection ports.

In accordance with these and other objects, which will become apparent hereafter, the instant invention will now be described with reference to the accompanying drawings.

DETAILED DESCRIPTION OF THE INVENTION

Figure 1:
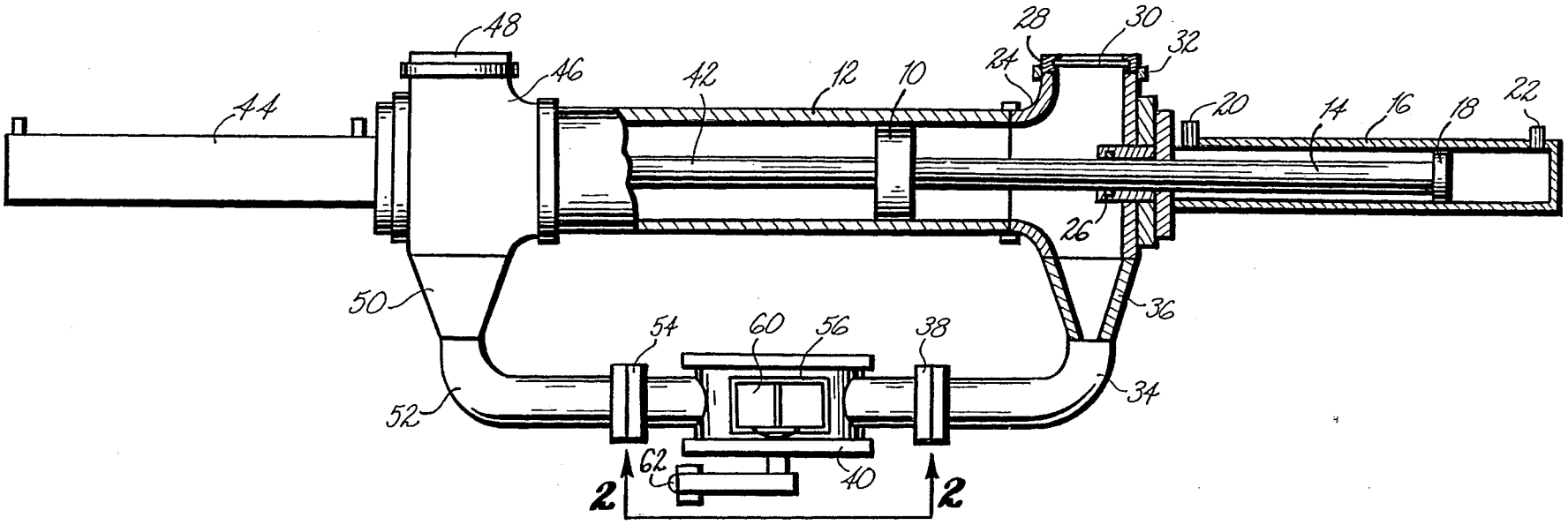
FIG. 1 is an elevation view, partially in cross-section of a dual action piston pump in accordance with the invention.

Referring now to FIG. 1, pump piston 10 is mounted for reciprocating movement in pump cylinder 12. On one side of piston 10 is mounted piston rod 14 which extends into drive cylinder 16 and has drive piston 18 mounted thereon. Cylinder 16 has connections 20 and 22 for the admission and discharge of a motive fluid such as air, hydraulic fluid, etc., by which piston 18 can be caused to move.

Mounted between pump cylinder 12 and drive cylinder 16 is transition section 24. Transition section 24 has a piston rod bearing including piston rod seal 26. Transition section 24 also has inspection port 28 having window 30. Clamp 32 holds inspection port 28 in position on transition section 24 to provide a rapid means for removing inspection port 28 if cleaning inside transition section 24 is needed.

Figure 2:
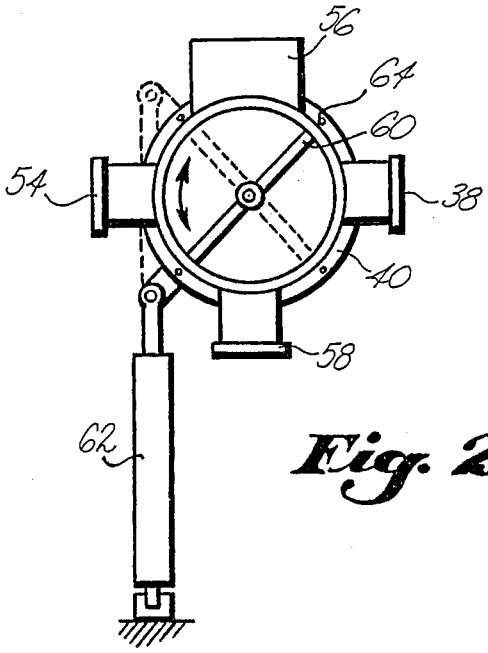
FIG. 2 is a detail view, partially in cross-section taken on the line 2—2 of FIG. 1.

Conduit 34 is connected to transition section 24 by truncated conical member 36. Conduit 34 has a cross-sectional area which is approximately one fifth of the net cross-sectional area of cylinder 12. Thus the medium being pumped will undergo a change in velocity in member 36 which will be smooth because of the conical configuration. Conduit 34 is connected to port 38 of four way valve 40, which is also shown in FIG. 2 with one side plate removed.

On the opposite side of piston 10 is secured piston rod 42 which is connected to a drive piston mounted within cylinder 44. Having equally sized, opposed pistons enables the pump piston 10 to be driven with equal force in both directions. Transition section 46 having inspection port 48, and conical member 50 connected to conduit 52, complete the opposite side components. Conduit 52 is connected to port 54 of valve 40. Valve 40 also has suction intake 56 and discharge 58. Valve spade 60 is moved between the position shown in solid lines and the position shown in broken lines, ninety degrees away, by valve spade controller 62. As shown in FIG. 2, valve spade 60 moves across pump connection ports 38 and 54 rather than suction intake port 56 and discharge 58 because the latter ports may be open. This prevents injury from the valve spade in case someone reaches in an open port. Suction intake 56 has at least twice the area of discharge 58. This allows thick and viscous materials to be sucked into the pump cylinder much easier, making the pump more efficient. Bolt holes such as bolt hole 64 are used to clamp the end plates onto valve 40.

Figure 3:
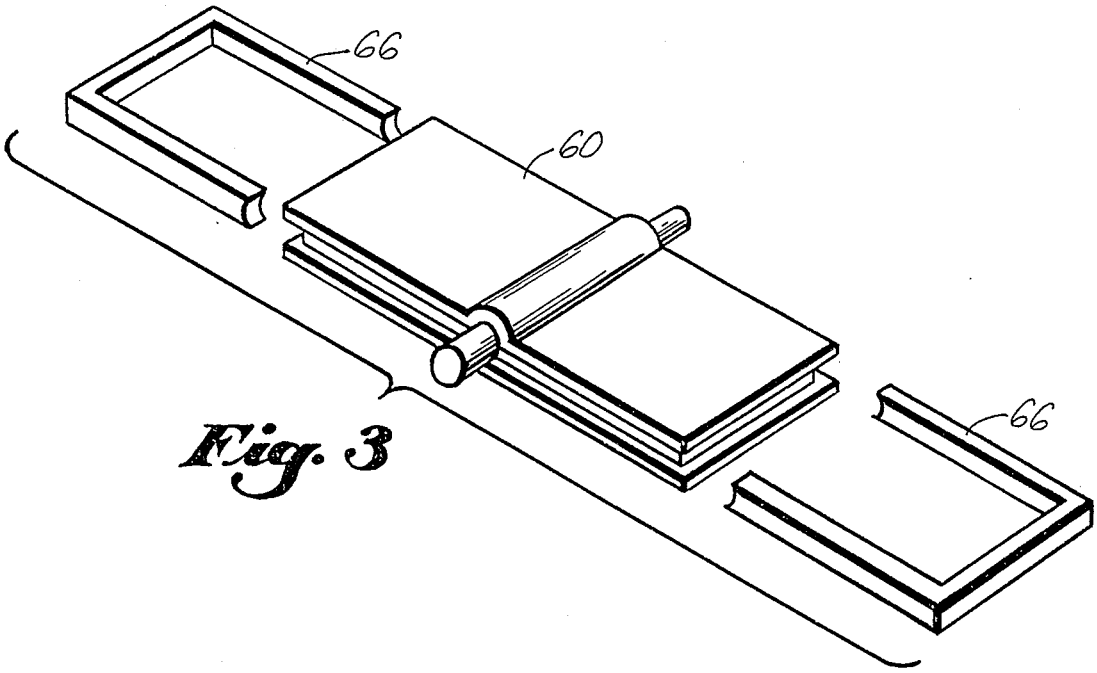
FIG. 3 is an exploded view of the spade used in the four way valve of the invention.

Turning to FIG. 3, valve spade 60 is shown to have slotted edges in which soft seals 66 fit. Seals 66 are thereby able to perform the sealing function, while the steel valve spade can cut through debris which enters valve 40.

In operation, assume that pump piston 10 is moving towards the right as viewed in FIG. 1. The medium being pumped is being forced from the right side of cylinder 12, through transition section 24 and conical member 36 to conduit 34. As the medium passes through conical member 36, it accelerates. The medium enters port 38 of valve 40 and leaves at discharge 58. The movement of pump piston 10 to the right simultaneously creates a partial vacuum on the left side of pump piston 10, causing the medium to enter suction intake 56 and pass through port 54 to conduit 52. The movement through conduit 52 is rapid because a comparatively large volume in cylinder 12 is being emptied. As the medium passes through conical member 50 it decelerates. At the end of the stroke to the right, valve spade actuator 62 moves valve spade 60 to the other position. Simultaneously, drive piston 18 starts forcing pump piston 10 to the left causing medium on the left side of piston 10 to be discharged and medium to be drawn in through suction intake 56 to fill the vacating volume on the right side of piston 10.

It should be noted that motive fluid can be supplied to both drive cylinders simultaneously to drive the pump piston, or only one drive cylinder need be used to drive if the material being pumped is not particularly viscous.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A dual action piston pump comprising:
a pump cylinder;
a pump piston mounted for reciprocating movement in said pump cylinder;
first and second piston rods extending from opposite sides of said pump piston;
first and second pump cylinder transition sections connected at opposite ends of said pump cylinder;
said first transition section having a first drive cylinder connected thereto coaxially with said pump cylinder;
said first drive cylinder having a proximal end adjacent to said first transition section and a distal end,
said second transition section having a second drive cylinder connected thereto coaxially with said pump cylinder;
said second drive cylinder having a proximal end adjacent to said second transition section and a distal end;
a first drive piston connected to said first piston rod and mounted for reciprocating movement in said first drive cylinder between said proximal end and said distal end;
a second drive piston connected to said second piston rod and mounted for reciprocating movement in said second drive cylinder between said proximal end and said distal end;
a four way valve having a first connection by a first tube to said first transition section and a second connection by a second tube to said second transition section;
said four way valve also having a suction intake and a discharge and a controlled valve spade moveable between a first position wherein said first tube is connected to said suction intake and said second tube is connected to said discharge, and a second position wherein said first tube is connected to said discharge and said second tube is connected to said suction intake; and a valve spade controller.

2. A dual action piston pump in accordance with claim 1 wherein:
said first and second transition sections each have a readily opened inspection port.

3. A dual action piston pump in accordance with claim 2 wherein:
said inspection ports have a window therein.

4. A dual action piston pump in accordance with claim 1 further including:
a first truncated conical member disposed between said first transition section and said first tube and a second truncated conical member disposed between said second transition section and said second tube.

5. A dual action piston pump in accordance with claim 1 wherein:
said pump cylinder has a greater net internal cross-sectional area than each said first and second tubes.

6. A dual action piston pump in accordance with claim 1 wherein:
said first drive cylinder has a motive fluid connection adjacent to said distal end of said first drive cylinder;
said second drive cylinder has a motive fluid connection adjacent to said distal end of said second drive cylinder.

7. A dual action piston pump in accordance with claim 6 wherein:
said first drive cylinder has a motive fluid connection adjacent to said proximal end of said first drive cylinder;
said second drive cylinder has a motive fluid connection adjacent to said proximal end of said second drive cylinder.

8. A dual action piston pump in accordance with claim 1 wherein:
said dual action piston pump is driven by a motive fluid.

9. A dual action piston pump in accordance with claim 8 wherein:
said motive fluid is hydraulic fluid.

10. A dual action piston pump in accordance with claim 1 wherein:
said suction intake has an area at least twice as large as said discharge.

11. A dual action piston pump in accordance with claim 10 wherein:
said suction intake is rectangular.

12. A dual action piston pump in accordance with claim 1 wherein:
said controlled valve spade has slotted edges and soft seals are contained in said slotted edges.

13. A dual action piston pump comprising:
a pump cylinder;
a pump piston mounted for reciprocating movement in said pump cylinder;
first and second piston rods extending from opposite sides of said pump piston;

first and second pump cylinder transition sections connected at opposite ends of said pump cylinder;

said first and second pump cylinder transition sections each have a readily opened inspection port and said inspection ports have a window therein;

said first transition section having a first drive cylinder connected thereto coaxially with said pump cylinder;

said first drive cylinder has a proximal end adjacent to said first transition section and a distal end;

said first drive cylinder has motive fluid connections adjacent to said proximal and distal ends;

said second transition section having a second drive cylinder connected thereto coaxially with said pump cylinder;

said second drive cylinder has a proximal end adjacent to said second transition section and a distal end;

said second drive cylinder has motive fluid connections adjacent to said proximal and distal ends;

a first drive piston connected to said first piston rod and mounted for reciprocating movement in said first drive cylinder;

a second drive piston connected to said second piston rod and mounted for reciprocating movement in said second drive cylinder;

a four way valve having a first connection by a first tube to said first transition section and a second connection by a second tube to said second transition section;

a first truncated conical member disposed between said first transition section and said first tube and a second truncated conical member disposed between said second transition section and said second tube;

said four way valve also having a rectangular suction intake and a discharge and a controlled valve spade moveable between a first position wherein said first tube is connected to said suction intake and said second tube is connected to said discharge, and a second position wherein said first tube is connected to said discharge and said second tube is connected to said suction intake; and a valve spade controller.

* * * * *